US005543780A

United States Patent [19]

McAuley et al.

[11] Patent Number: 5,543,780

[45] Date of Patent: Aug. 6, 1996

[54] MONITORING TAG WITH REMOVAL DETECTION

[75] Inventors: John M. McAuley, Concord; Joseph Field, Hudson, both of N.H.

[73] Assignee: Secure Care Products, Inc., Boscawen, N.H.

[21] Appl. No.: 491,449

[22] Filed: Jun. 16, 1995

[51] Int. Cl.[6] ..... G08B 13/187; G08B 29/04

[52] U.S. Cl. ..... 340/573; 340/568; 340/600

[58] Field of Search ..... 340/573, 568, 340/600

[56] References Cited

U.S. PATENT DOCUMENTS

| | | | |
|---|---|---|---|
| 4,471,345 | 9/1984 | Barrett, Jr. | 340/572 |
| 4,482,890 | 11/1984 | Forbes et al. | 340/600 |
| 4,885,571 | 12/1989 | Pauley et al. | 340/573 |
| 4,918,432 | 4/1990 | Pauley et al. | 340/573 |
| 4,952,913 | 8/1990 | Pauley et al. | 340/573 |
| 5,014,040 | 5/1991 | Weaver et al. | 340/572 |
| 5,196,825 | 3/1993 | Young | 340/539 |
| 5,245,317 | 9/1993 | Chidley et al. | 340/571 |
| 5,285,194 | 2/1994 | Ferguson | 340/572 |
| 5,374,921 | 12/1994 | Martin et al. | 340/568 |

*Primary Examiner*—Glen Swann

*Attorney, Agent, or Firm*—Hayes, Soloway, Hennessey, Grossman & Hage P.C.

[57] ABSTRACT

A tag is provided for being secured to an object whose location is to be monitored. Improved mechanisms are provided for ensuring that removal of the tag is detected and signaled to a monitoring system. One preferred embodiment of the tag of the present invention includes an optical sensor for sensing when the tag is near the surface of the object whose location is being monitored. The optical sensor emits optical signals to the surface of the object being monitored and receives reflected optical signals back therefrom. The tag periodically transmits status messages to the monitoring system which permit the monitoring system to determine whether the tag is being held near the object and whether the tag is within the monitored area. In another embodiment of the present invention, a temperature sensor is substituted for the optical sensor.

22 Claims, 6 Drawing Sheets

MONITORING TAG WITH REMOVAL DETECTION

BACKGROUND OF THE INVENTION

1. Field of the Invention

The present invention relates generally to monitoring systems, and more particularly to a tag for use with a remote monitoring system for determining the physical whereabouts of a tagged object or person. More specifically, the invention concerns a tag having improved means for ensuring that removal of the tag is detected and signalled to the monitoring system. Particular utility for the present invention is found in the area of monitoring the whereabouts of mental patients, individuals suffering from senile dementia, and children, although other utilities are also contemplated, including other personnel and object monitoring applications.

2. Brief Description of Related Prior Art

Many devices presently exist for monitoring the physical location of objects and individuals. Many such systems use a tag secured to the object or individual whose location is to be monitored for transmitting radio-frequency signals to a remote monitoring system. The remote system uses the signals transmitted by the tag to determine the whereabouts of the object or individual carrying the tag.

One prior art monitoring system is disclosed in U.S. Pat. No. 4,885,571 to Pauley et al. In Pauley et al., the tag is worn by an individual being monitored, preferably on the individual's ankle or leg where it can be easily concealed by the individual's clothing. The tag is self-contained and sealed. The tag contains electronic circuits for periodically generating identification signals including an identification code. The identification signal modulates a stable radio-frequency signal that is transmitted in bursts of data words to a receiver associated with a field monitoring device (FMD) located at the area of confinement of the arrestee. The FMD randomly establishes communication with a central processing unit (CPU) located at a central monitoring location. The identification code also includes information indicating that an attempt has been made to remove the tag from the individual. The tag is held in place near the skin of the wearer by a conductive strap that wraps around the leg or other limb of the wearer. Two capacitive electrodes, one of which is realized by the strap, function as plates of a capacitor, with the body flesh of the wearer serving as the dielectric material of the capacitor. Thus, the two electrodes provide electrostatic coupling through the body mass of the wearer. By monitoring an alternating signal coupled from one capacitive electrode to the other, a determination can be made as to whether the tag has remained near the body flesh of the wearer. Additionally, a signal is passed through the conductive strap to permit a determination to be made as to whether the strap as been broken. The periodic signals transmitted by the tag permit the monitoring system to determine whether the person being monitored is within the area being monitored.

Thus, the tag disclosed in Pauley et al. utilizes a capacitive coupling to transmit electrical signals through the wearer's body to monitor whether the tag is being held near the wearer's skin or has been removed therefrom. Although this technique is somewhat effective in determining whether the tag is secured to the individual or object being monitored, it suffers from certain disadvantages. For example, some mental patients, individuals suffering from senile dementias, and children have an irrational fear of electrical energy and are terrified of having electrical energy transmitted through their bodies. Such individuals usually will not willingly consent to wear the tag disclosed in Pauley et al. and may become violent and/or agitated if they are forced to wear it, and/or will remove the tag when they are left unattended.

Additionally, transmission of electric energy through certain types of magnetic recording media (e.g., magnetic tape, disks, etc.) can damage or destroy the information stored on the media. This renders the capacitive monitoring tag of Pauley et al. generally undesirable for use in monitoring the location of such media.

Other prior art tag monitoring systems are disclosed in U.S. Pat. No. 5,285,194 to Ferguson; U.S. Pat. No. 5,245,317 to Chidley et al.; U.S. Pat. No. 5,196,825 to Young; U.S. Pat. No. 5,014,040 to Weaver et al.; U.S. Pat. No. 4,952,913 to Pauley et al.; U.S. Pat. No. 4,918,432 to Pauley et al.; and U.S. Pat. No. 4,471,345 to Barrett, Jr. The tag monitoring systems disclosed in these patents suffer from the aforesaid and/or other disadvantages.

OBJECTS OF THE INVENTION

It is therefore the general object of the present invention to provide a tag for use with a remote monitoring system that overcomes the aforesaid and other disadvantages of the prior, and more specifically, to provide such a tag that includes improved means for determining whether the tag is being held near the object being monitored and for signalling this condition to the monitoring system, which means does not require transmission of electrical energy through the object being monitored.

SUMMARY OF THE INVENTION

According to one embodiment of the present invention, a tag is provided for being secured near a surface of an object to be monitored for use in determining whether the object is physically within an area being monitored by a remote monitoring system. The tag includes electromagnetic or optical means for sensing when the tag is being held near the surface of the object and means for periodically transmitting status messages to the monitoring system, which messages permit the monitoring system to determine whether the tag has determined that it is being held near the surface of the object and whether the tag is within the area being monitored by the system.

In accordance with another embodiment of the present invention, a tag for being secured near a skin surface of a warm-blooded animal and for use in determining whether the animal is within an area monitored by a monitoring system is provided. The tag of this embodiment of the present invention essentially comprises means for sensing the temperature near the tag and for determining based upon the sensed temperature whether said tag is near the skin surface. Also in this embodiment, means are provided for periodically transmitting status messages to the remote monitoring system. The status messages permit the monitoring system to determine whether the tag is near the skin surface and whether the tag is within the area being monitored.

Advantageously, the tag of the present invention does not suffer from the aforesaid and/or other disadvantages of the prior art. Specifically, the tag of the present invention permits the remote monitoring system to determine whether the tag is being held near the object whose location is being monitored, but does not require transmission of electrical energy through the object to do so.

These and other objects, features, and advantages of the present invention will become apparent as the following Detailed Discussion proceeds and upon reference to the Drawings, in which like numerals depict like parts, and wherein:

Figure 1:
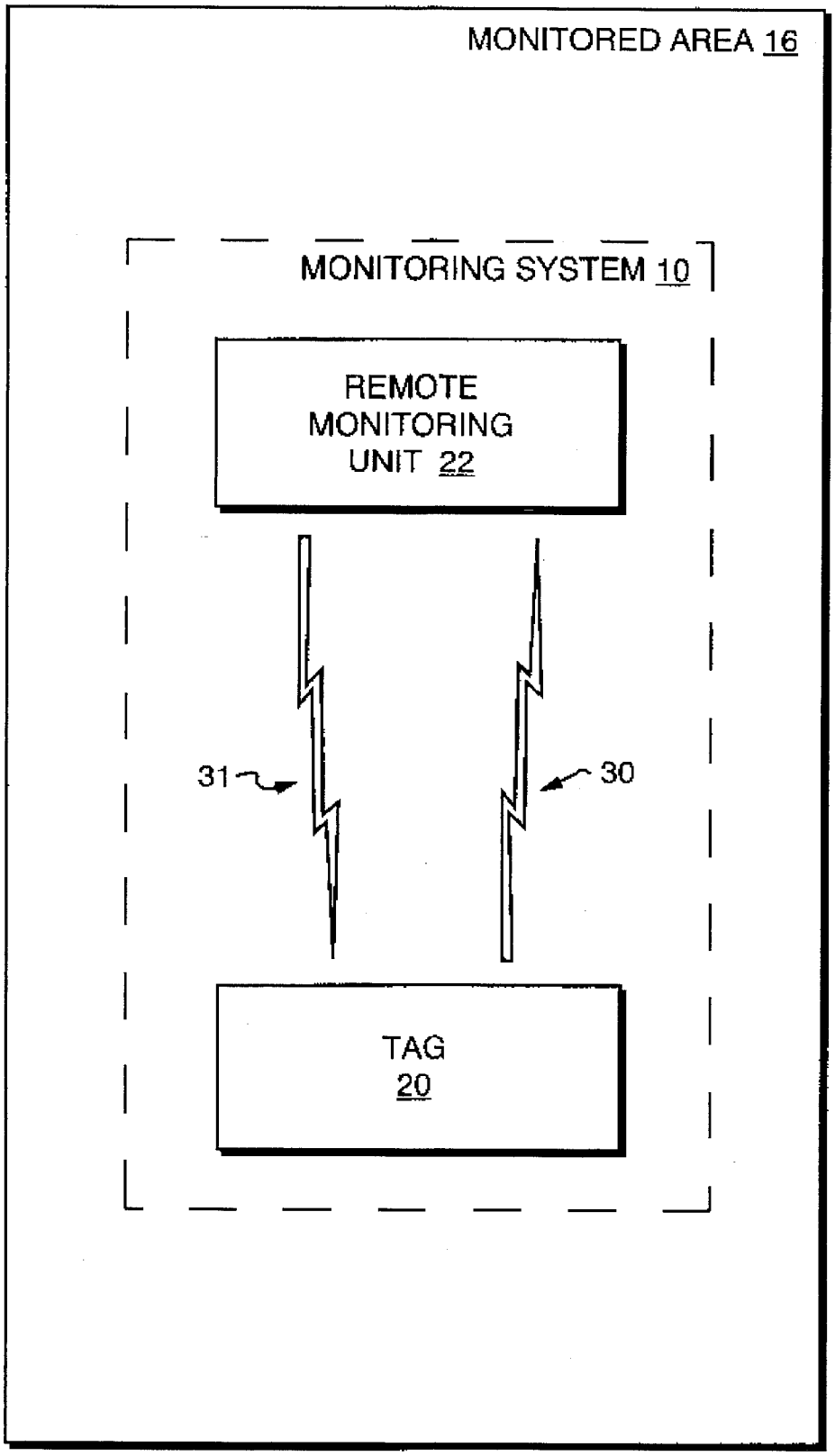
FIG. 1 is a functional block diagram of an object location monitoring system for use with one preferred embodiment of the tag of the present invention.
Figure 2:
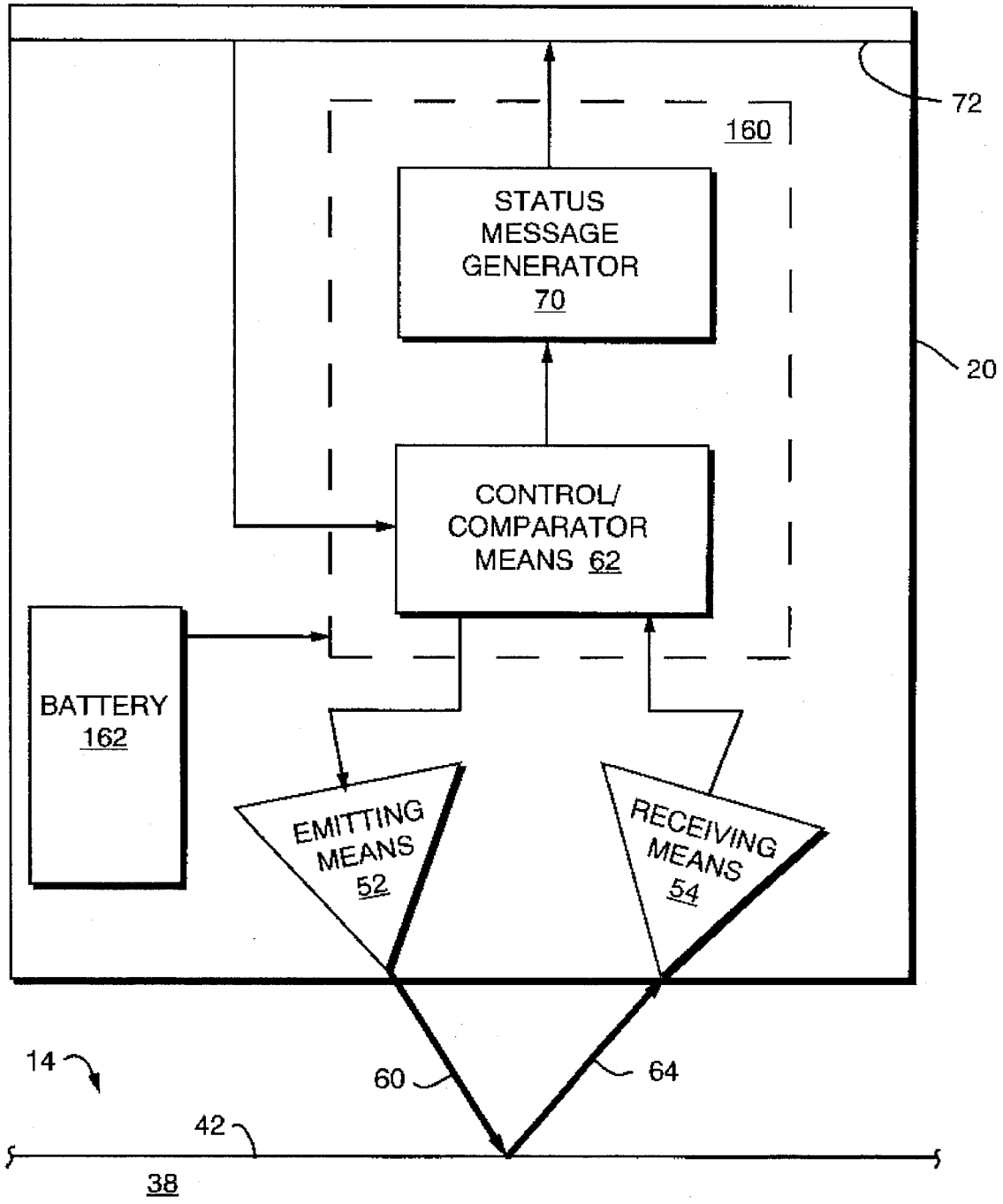
FIG. 2 is a more detailed functional block diagram of the preferred embodiment of the tag of FIG. 1 in which the tag is shown in conjunction with the skin of a wearer to facilitate discussion of the operation of the tag.
Figure 4:
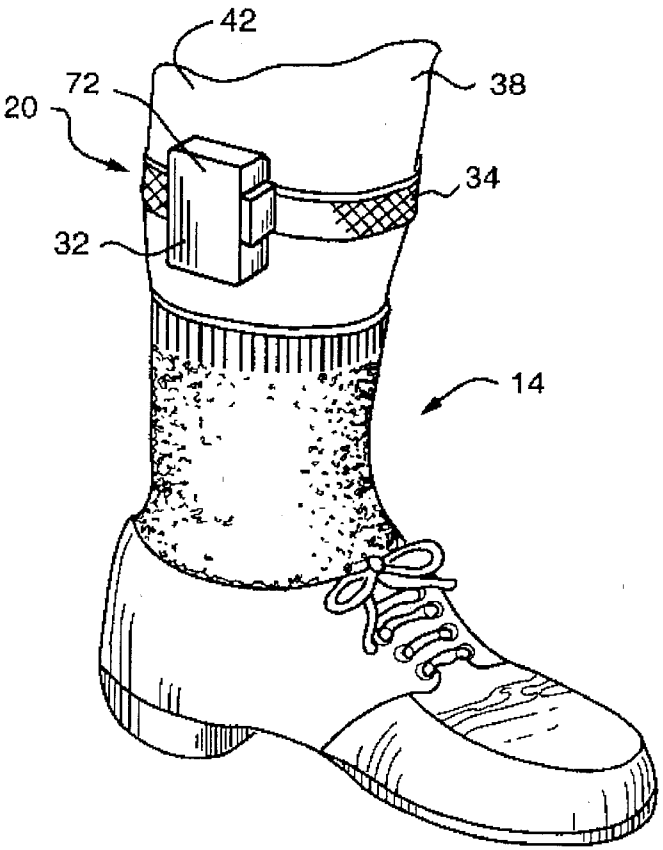
FIG. 4 illustrates one preferred manner for the tag of FIGS. 1–3 to be worn.
Figure 3:
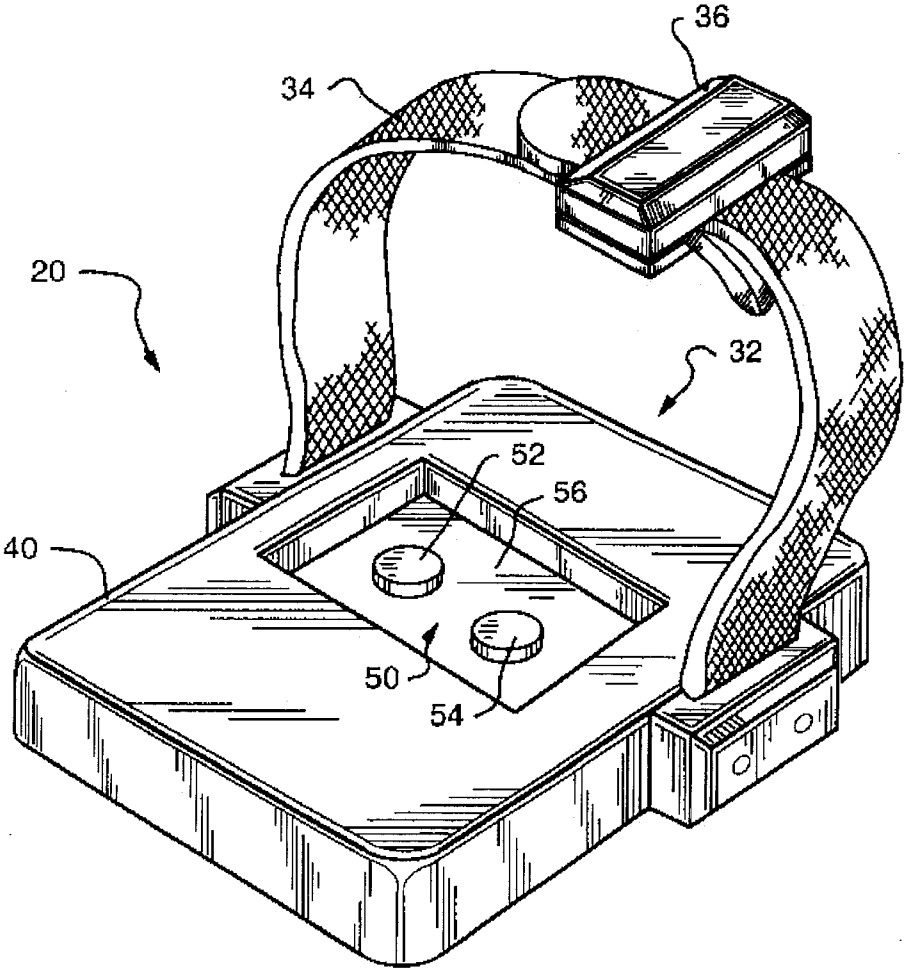
FIG. 3 is a perspective view of the tag of FIG. 2.

Although the following Detailed Description will proceed with reference to particular preferred embodiments and methods of use, it will be appreciated by those skilled in the art that many alternatives, modifications, and variations thereof are possible without departing from the present invention. For example, although various preferred embodiments of the present invention will be described in connection with being used to monitor location of a human being, it should be understood that if appropriately modified in ways apparent to those skilled in the art, these embodiments may be also used for monitoring other animals and/or inanimate objects. Accordingly, the present invention is not intended to be limited to these preferred embodiments and methods of use, but rather should be viewed as being limited only set forth in the hereinafter appended claims.

DETAILED DESCRIPTION OF PREFERRED EMBODIMENTS

With particular reference being made to FIGS. 1–4, a system 10 will be described for monitoring whether an object 14 is physically within a monitored area 16 (e.g., a house, medical treatment facility, yard area, etc.), which system 10 uses one preferred embodiment 20 of the tag of the present invention. System 10 includes tag 20 for periodically transmitting radio or microwave frequency status messages 30 to a conventional remote monitoring unit 22. As will be described more fully below, the status messages 30 transmitted to the remote unit 22 permit the remote unit 22 to determine whether the tag 20 is physically located within the monitored area 16.

Tag 20 of this embodiment of the present invention comprises an outer protective housing 32 of metal or hard plastic attached to leather or plastic straps 34 and conventional fastening means 36 for securing the tag 20 to the leg 38 or other limb of an individual 14 whose location is being monitored. Preferably, for reasons that will be explained more fully below, tag 20 is attached to the individual 14 in such a way that the bottom side 40 of the tag 20 is placed near the skin surface 42 of the person 14 wearing the tag 20.

Tag 20 comprises electromagnetic or optical sensing means 50. Sensing means 50 comprises emitting means 52 and receiving means 54 mounted in a recessed central portion 56 of the bottom 40 of the tag 20 near the skin 42 of the wearer 14. Emitting means 52 periodically emits a beam 60 of electromagnetic or optical energy to the skin 42 of the wearer in response to control signals generated by control means 62 (which e.g., comprises a conventional programmed microprocessor or similar microcontroller device and appropriate RAM and/or ROM memory). Emitting means 52 comprises a light emitting diode, infra-red source, low-power laser source, or other type of conventional electronically controllable very high frequency electromagnetic or optical energy generating device. The beam 60 emitted by emitter 52 contacts the skin 42 and is reflected therefrom. The reflected beam 64 is received by the receiving means 54, which means 54 generates appropriate electrical signals characteristic of the reflected beam 64 (i.e., related to physical characteristics of the beam 64, such as, power, phase, modulation, and/or wavelength characteristics). Preferably, receiving means 54 comprises one or more conventional photodiodes or other similar devices.

The electrical signals generated by the receiving means 54 in response to the reflected beam 64 are transmitted to the control means 62. The control means 62 then determines what differences exist between the reflected 64 beams and one or more expected characteristics thereof (e.g., expected frequency spectra, amplitude, frequency modulation, amplitude modulation, phase shift, power, etc.) Preferably, prior to making this determination, control means 62 uses conventional signal processing techniques and/or algorithms to filter or mask out portions of the electrical signals erroneously generated by the receiving means 52 (i.e., generated not as a result of received beam 64, but rather due to electrical, optical, and/or electromagnetic noise). If comparator means 62 determines that the predetermined characteristics of beam 64 differ from those expected therefor by more than a predetermined error tolerance thereof, this condition is taken by control means 62 as being indicative of removal of the tag 20 from being near the skin surface 42 and is signalled to the conventional status message generator means 70.

Status message generator 70 periodically generates radio-frequency status messages for transmission to the remote system 22 via the antenna means 72. Preferably, these status messages include information signals for permitting the remote system to determine the identity of the individual being monitored by the tag (i.e., tag identification information) and whether the tag 20 has determined that the tag 20 has been removed from the individual being monitored. Preferably, the remote system 22 includes means (not shown) for determining whether the transmission strength of the transmitted radio frequency status messages is below a predetermined threshold value therefor indicative of removal of the tag from the monitored area.

A preferred method for calibrating the expected characteristics of the received beam and error tolerance used in determining whether the tag is being held near the skin will be described. When tag 20 is first attached to the wearer (or at any other time when calibration of the tag is desired), the remote unit 22 is caused (by e.g., attendant personnel) to generate and transmit to the tag 20 a radio frequency initialization command 31. Upon receipt of the initialization command, the control means of the tag causes the emitting means to generate and transmit a beam having one or more predetermined characteristics to the skin surface. The reflected beam is received by the receiving means, which generates electrical signals representative of the reflected beam. This is repeated a predetermined number of times and the control means determines and stores actual values of the characteristics of the received beam. The control means then calculates an average of these values, which average is used as the expected value thereof and the error tolerance is generated using the expected value, the stored values, and conventional statistical regression techniques.

Preferably, the control means, emitter means, and receiver means are appropriately adapted in ways known to those skilled in the art to transmit and receive electromagnetic or optical beams that are frequency and/or amplitude modulation coded. In this way, a predetermined coding pattern may be impressed upon the transmitted beam 60, which coding is specifically adapted to be changed in the reflected beam 64 as a function of electromagnetic or optical reflectance characteristics of the skin surface. Expected differences in coding between the transmitted 60 and reflected 64 beams may then be calibrated into the tag 20 in the manner described previously. By using such a coding scheme, it becomes more difficult for someone to remove the tag, yet nonetheless fool the tag into indicating that it is still being held near the skin surface (e.g., by placing the receiving and transmitting means near a reflective surface, such as a mirror). Additionally, by using this calibration scheme, signalling of false tag-removal conditions due to differences in received beam characteristics measured by the receiving means as a result of variations in human skin pigmentation, closeness of the tag against the skin, skin/light diffusion and transmission characteristics, etc. may be substantially eliminated.

Preferably, the status message generator and control means are comprised in a single microcontroller integrated circuit chip 160 connected to the emitting means, receiving means, antenna, and a miniature battery power supply 162. Transmit/receive antenna 72 preferably comprises a conventional radiating strip or plate-type antenna mounted in the strap or housing of the tag.

In operation of tag 20, the tag 20 is first fastened or secured to the skin surface of the wearer by the straps and locking fastener. The bottom of the tag is placed near the wearer's skin. The remote unit 22 then commands the tag 20 via radio frequency calibration command signals to undergo initial calibration, which is then carried out by the tag 20. Once the tag is finished calibrating the expected characteristics and error tolerance or tolerances for the received beams, the tag begins periodically emitting beams of electromagnetic or optical energy to the skin surface. If the emitter is near the skin surface, the beams are reflected from the skin surface and the reflected beams are detected by the receiving means. The control means then determines the actual characteristics of the received reflected beams, and compares these actual characteristics to the expected values thereof. If the actual characteristics are outside the previously calculated error threshold, then the control means commands the status message generator to signal the remote unit that the tag has been removed from the skin surface. The status message generator periodically transmits radio frequency status messages to the remote unit via the antenna means, which messages indicate which tag is transmitting the message (i.e., tag identification information) and whether the tag has been removed from the wearer. The output signal power of the message signals is chosen such that when the tag is outside of a desired monitoring area for the system 10, the remote unit will be able to determine this fact from the reduced signal strength of the messages signals received by the remote unit.

Figure 5:
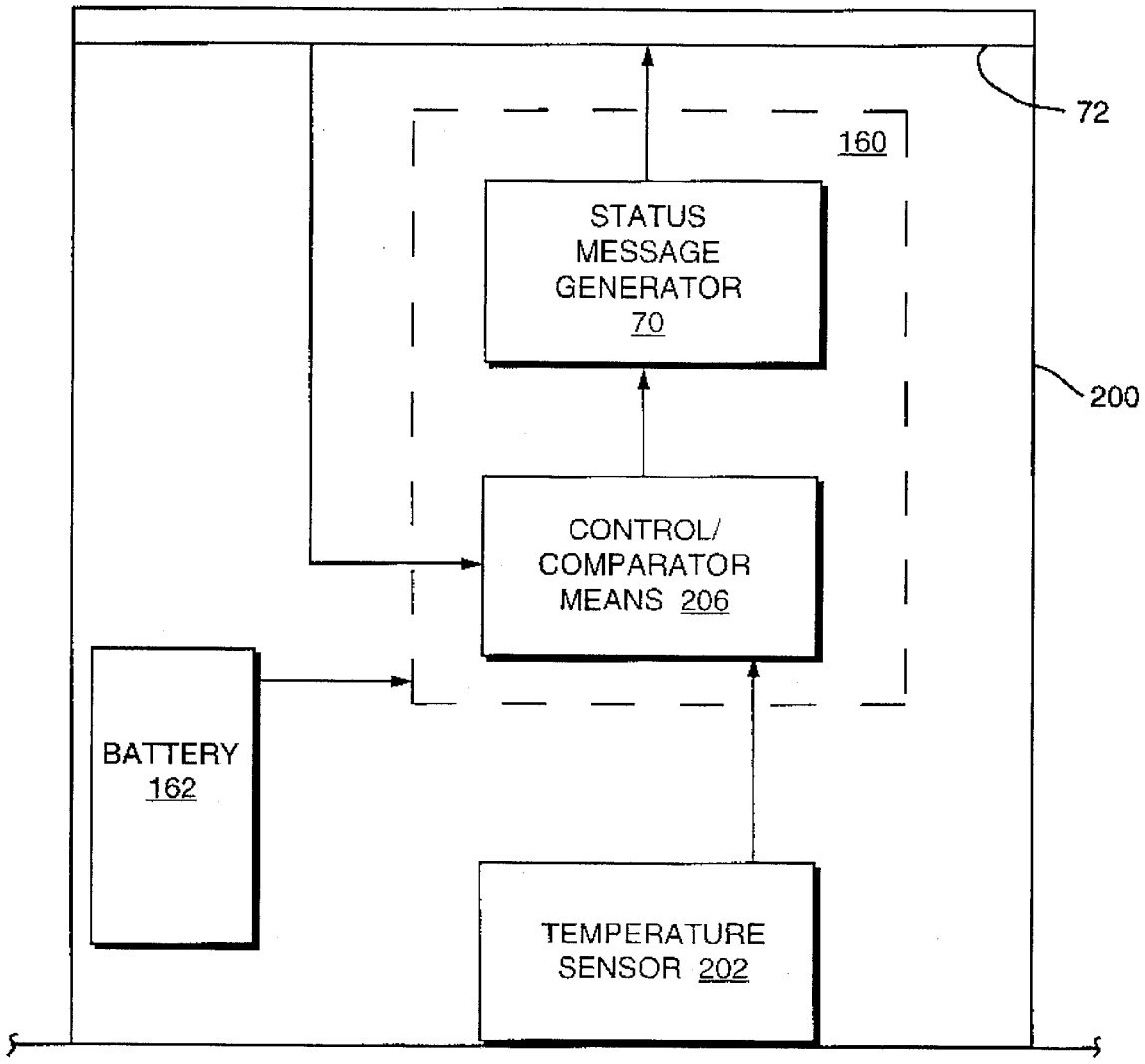
FIG. 5 is a functional block diagram of another preferred embodiment of the tag of the present invention, in which the tag is shown in conjunction with the skin of a wearer to facilitate discussion of the operation of the tag.
Figure 7:
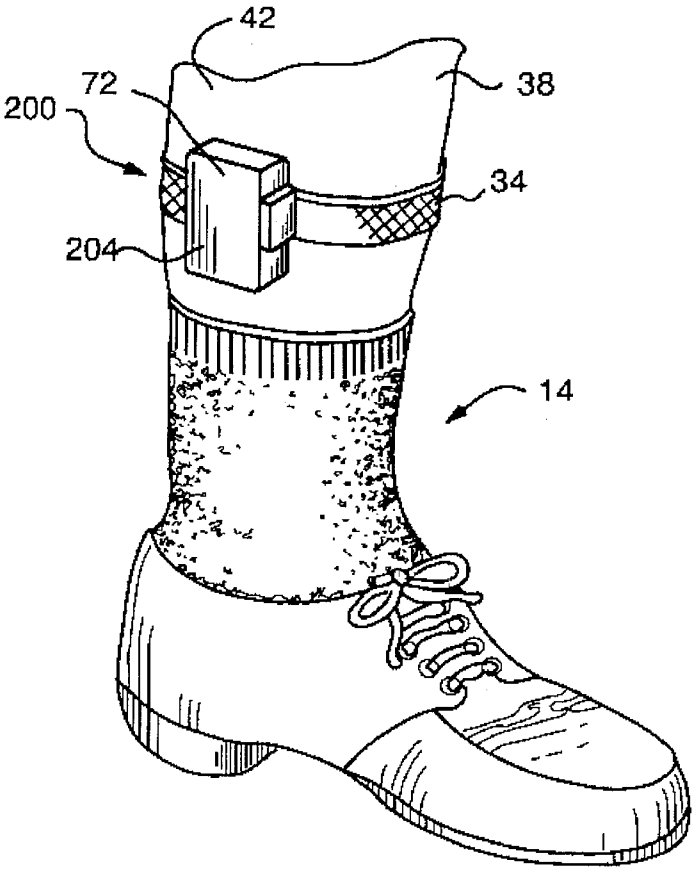
FIG. 7 illustrates one preferred manner for the tag of FIGS. 5–6 to be worn.
Figure 6:
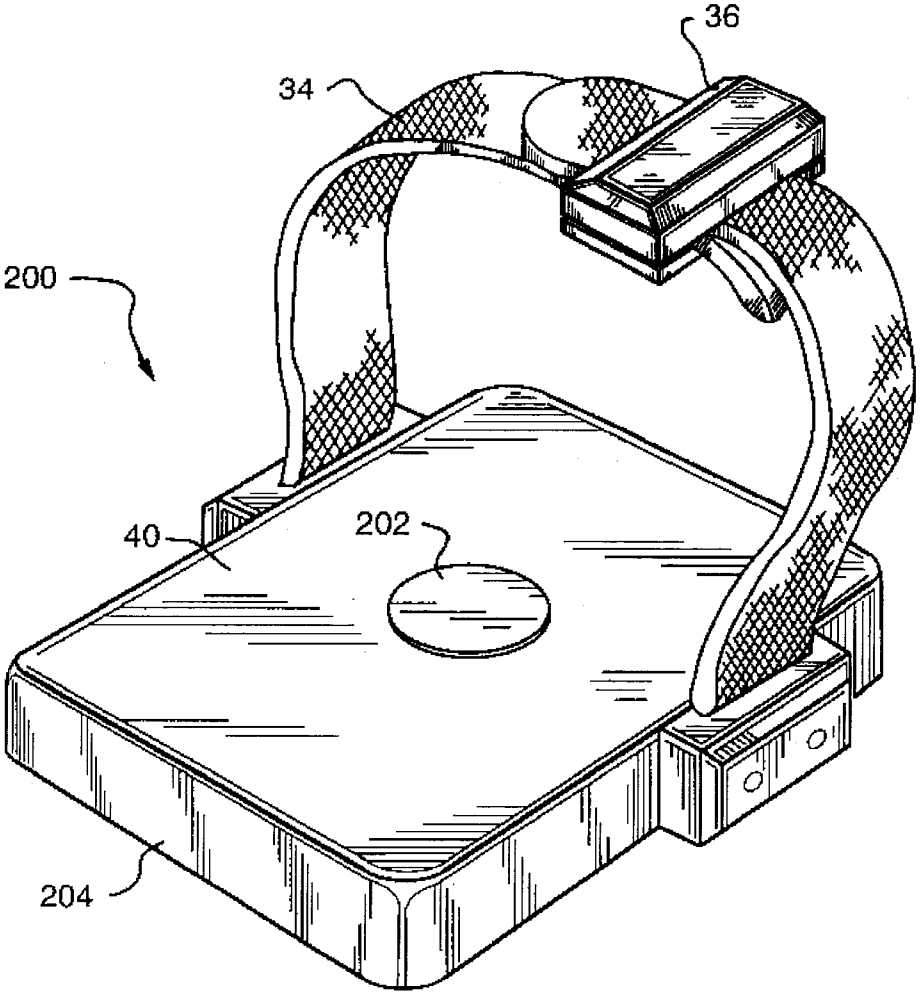
FIG. 6 is a perspective view of the tag of FIG. 5.

Turning to FIGS. 5–7, another preferred embodiment 200 of the present invention will now be described. Unless indicated to the contrary, it should be understood that tag 200 comprises substantially the same elements and operates in substantially the same way as tag 20.

Tag 200 comprises a conventional skin surface temperature sensor 202 mounted in housing 204 so as to fit snuggly against the skin surface of the wearer when the tag 200 is fastened onto the wearer. Temperature sensor 202 constantly monitors the temperature of the skin surface. Control means 206 compares the temperatures sensed by the sensor means 202 to a predetermined normal range therefor. If the control means 206 determines that the temperatures sensed by the sensor 202 is outside the predetermined normal range, this condition is taken by the control means as being indicative of the tag having been removed from the skin of the wearer (i.e., that the tag 200 is no longer being held or secured near the skin surface), which means 206 then commands the status message generator to signal the remote system that the tag 200 has been removed from the wearer.

The normal range of temperatures to which the actual the temperatures sensed by the means 202 is compared by the control means 206 may either be preprogrammed into the control means using widely available epidemiological data therefor, or may be calibrated upon initial securing of the tag 200 to the wearer, in the manner described more fully below.

In order to calibrate into the control means 206 the normal temperature range expected to be sensed by the sensor means 202, the tag 200 is initially fastened onto the wearer so that the sensor 202 is secured tightly against the skin surface. The remote unit then commands the tag 200 to calibrate the normal temperature range expected to be sensed by the sensor 202. In response to these calibration commands, the control means 206 commands the sensor means 202 to monitor skin temperatures for a predetermined period of time sufficient to determine the expected temperature range. These temperatures are then analyzed by the control means 206, which then determines the average temperature during the time period as well as the statistical standard deviation thereof. The control means then uses these values to determine the statistically expected temperature range for the skin surface, which range is stored in the control means for later use in determining whether the tag 200 has been removed from the skin surface.

Figure 8:
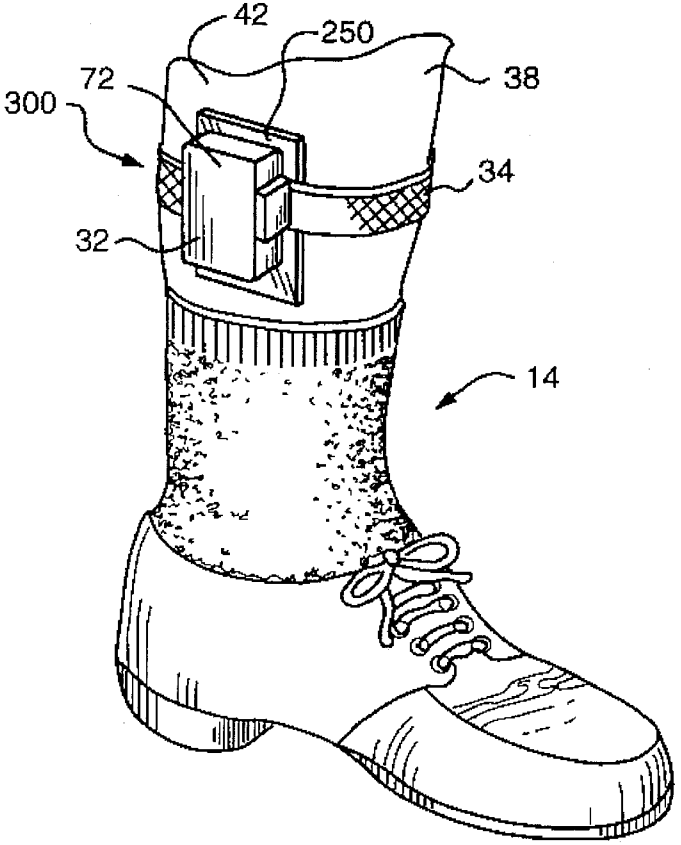
FIG. 8 illustrates a variation of the embodiment of FIGS. 1–4 which variation is shown being worn by a wearer to facilitate discussion of the operation of said variation.

Thus, it is evident that there has been provided in accordance with the present invention a tag for use with a monitoring system that fully satisfies the aims and objectives hereinbefore set forth. Although the foregoing description has been made with reference to preferred embodiments and methods of use, it will be appreciated that many alternatives, modifications, and variations thereof are possible without departing from the present invention. For example, as shown in FIG. 8, tag 300 may comprise a layer of man-made electromagnetically and/or optically reflective material 250 removably secured to the skin surface by conventional means (e.g., tape or contact glue) beneath the bottom of the housing. The material 250 is chosen so as to have a frequency spectral response to electromagnetic and optical energy emitted by the emitter means that is different from that of the skin surface and other items commonly found in nature. The control means of tag 300 is calibrated (or preprogrammed) to expect the reflected beam to have the spectral response caused by the material 250. Thus, if the tag 300 is removed from the wearer, this condition will be signalled by the tag 300 to the remote unit, and other types of reflective material (other than the material 250) placed near the bottom surface of the tag are not likely to cause the tag 300 to falsely signal that the tag 300 is currently secured to the wearer.

Other modifications are also possible. For example, if the receiving and control means of tag 20 are appropriately modified, the tag 20 may be adapted to receive and process electromagnetic or optical energy diffused from the skin surface as a result of the emitted beam, rather than the reflected beam.

Figure 9:
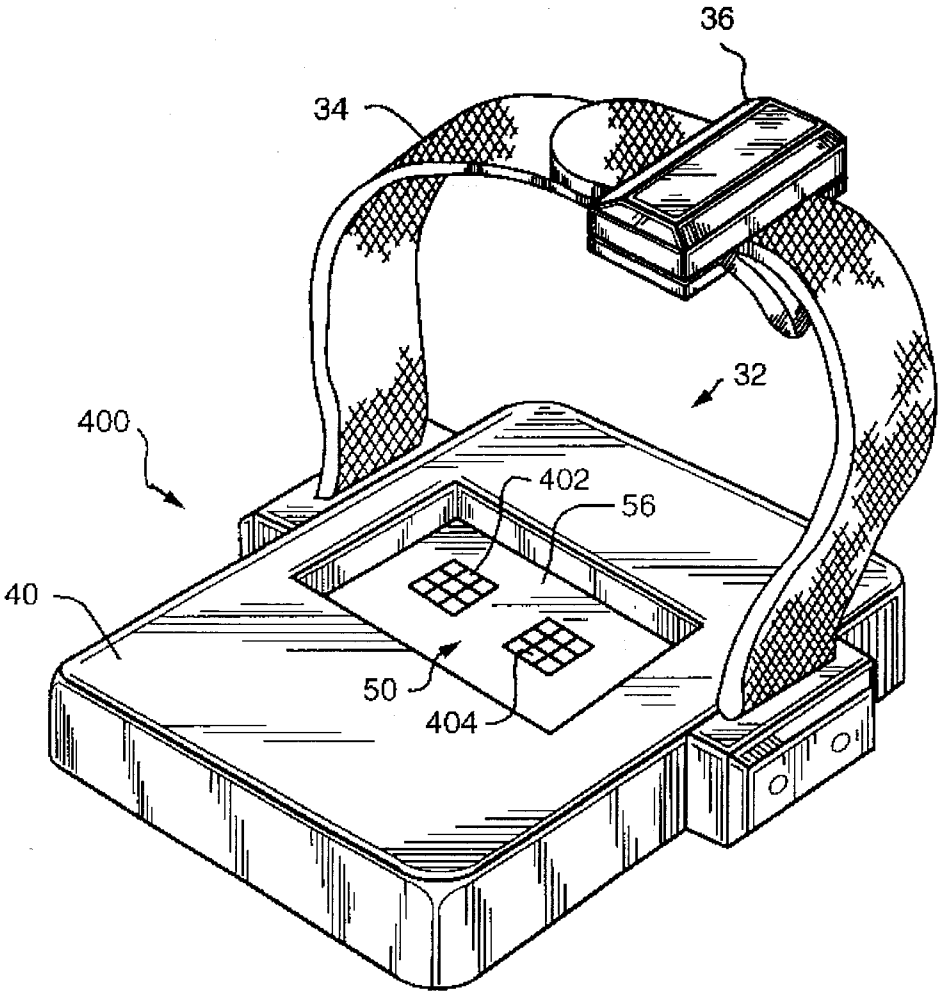
FIG. 9 is a perspective view of yet another variation of the embodiment of FIGS. 1–4.

Additionally, as shown in FIG. 9, tag 400 may comprise an array 402 of a plurality of electromagnetic or optical emitting means and an array 404 of receiving means. Other modifications are also possible. Accordingly, the present invention should be viewed quite broadly, as being limited only as set forth in the hereinafter appended claims.

What is claimed is:

1. A tag for being secured near a surface of an object and for use in determining whether said object is within an area monitored by a monitoring system, and comprising, in combination:

a. optical means for sensing when said tag is near said surface of said object, said optical sensing means including means for emitting optical signals to said surface and for receiving reflected optical signals back therefrom; and b. means for periodically transmitting status messages to said monitoring system, said status messages permitting said monitoring system to determine whether said tag is being held near said object and whether said tag is within said area.

2. A tag according to claim 1, wherein said incident and reflected signals comprise coded signals.

3. A tag according to claim 1, and further comprising control means for comparing said emitted and reflected signals.

4. A tag according to claim 3, wherein said control means comprises means for masking out ambient light from said reflected signals received by said receiving means.

5. A tag according to claim 1, wherein said optical sensing means comprises infrared sensing means.

6. A tag according to claim 1, wherein said tag further comprises means for comparing actual frequency spectra of said reflected optical signals to expected spectra therefor whereby to determine whether said tag is near said surface.

7. A tag for being secured near a surface of an object and for use in determining whether said object is within an area monitored by a monitoring system, and comprising, in combination:

a. a layer of optically reflective material secured to said surface, said material having an optical spectral response that is different from that of said surface;

b. optical means for sensing when said tag is near said surface of said object, said optical sensing means comprising means for emitting incident optical signals to said layer and for receiving reflected optical signals back therefrom; and c. means for periodically transmitting status messages to said monitoring system, said status messages permitting said monitoring system to determine whether said tag is being held near said object and whether said tag is within said area.

8. A tag according to claim 1, wherein said tag further comprises means for comparing actual characteristics of said reflected signals to expected values thereof.

9. A tag according to claim 8, wherein said characteristics comprise frequency spectra.

10. A tag according to claim 8, wherein said characteristics comprise signal amplitude.

11. A tag according to claim 8, wherein said characteristics comprise signal modulation.

12. A tag according to claim 8, wherein said characteristics comprise coding of said signals.

13. A tag according to claim 8, wherein said characteristics comprise phase of said signals.

14. A tag according to claim 8, wherein said expected values are determined by using calibration means.

15. A tag for being placed near a skin surface of a warm-blooded animal and for use in determining whether said animal is within an area monitored by a monitoring system, and comprising:

a. means for sensing temperature near said tag and for determining based upon the sensed temperature whether said tag is near said surface; and b. means for periodically transmitting status messages to said monitoring system, said status messages permitting said monitoring system to determine whether said tag is near said surface and whether said tag is within said area.

16. A tag according to claim 15, wherein said sensing means includes means for determining whether said sensed temperature is within a predetermined range of temperatures expected near said skin surface of said animal.

17. A tag for being held near an object and for being used along with a monitoring system whereby to determine physical location of said object, and comprising:

a. means for transmitting electromagnetic energy to said object and for receiving a reflection of said energy back therefrom, at least one characteristic of said energy having been modified by being reflected from said object;

b. means for comparing said at least one modified characteristic to an expectation therefor and for determining based upon said comparison whether said tag is being held near said object; and c. means for transmitting messages to said monitoring system for permitting said monitoring system to determine said location and whether said tag is near said object.

18. A tag according to claim 17, wherein energy is coded and said characteristic comprises coding of said energy.

19. A tag for being held near an object and for being used along with a monitoring system whereby to determine physical location of said object, and comprising:

a. an electromagnetic sensor for transmitting electromagnetic energy to said object and for detecting a reflection of said energy back therefrom, said sensor also being for determining when said tag is near said object based upon detection of said reflection; and b. a transmitter for transmitting status messages to said monitoring system whereby to permit said monitoring system to determine whether said tag is being held near said object and whether said tag is within said area.

20. A tag according to claim 19, and further comprising, control means for calculating an expected value of at least one characteristic of said reflection and an error tolerance for said expected value.

21. A tag according to claim 20, wherein said calculations of said expected value and said error tolerance are based, at least in part, upon signals representative of a plurality of reflections of electromagnetic energy received by said sensor.

22. A tag according to claim 19, wherein said tag determines whether said tag is near said object by comparing an actual value of said at least one characteristic of said reflection detected by said sensor to said expected value and said error tolerance calculated by said control means.

* * * * *